United States Patent [19]

Lewis

[11] 4,059,223

[45] Nov. 22, 1977

[54] CENTRIFUGE PRESSURE RELIEF DEVICE

[75] Inventor: Kenneth Dan Lewis, Wilton, Conn.

[73] Assignee: Dorr-Oliver Incorporated, Stamford, Conn.

[21] Appl. No.: 714,645

[22] Filed: Aug. 16, 1976

[51] Int. Cl.[2] ..... B04B 7/00

[52] U.S. Cl. ..... 233/1 R; 233/29

[58] Field of Search ..... 233/1 R, 1 B, 27, 28, 233/29; 81/57.38; 85/32 T, 32 R

[56] References Cited

U.S. PATENT DOCUMENTS

| | | | |
|---|---|---|---|
| 2,760,393 | 8/1956 | Stough | 81/57.38 |
| 3,230,799 | 1/1966 | Maciulaitis | 81/57.38 |
| 3,279,689 | 10/1966 | Honeychurch | 233/46 X |

*Primary Examiner*—George H. Krizmanich

*Attorney, Agent, or Firm*—B. J. Kearns; T. M. Jablon

[57] ABSTRACT

Apparatus arrangement and Method for providing pressure relief for the locking ring in the rotor of nozzle type centrifugal machines. The locking ring secures the top cover section to the main body section of the rotor bowl, against the internal compression pressure exerted by the stack of separating discs confined between the top and bottom of the rotor bowl. Pressure relief for the locking ring is provided by absorbing or sustaining said internal pressure by means separate from the locking ring. The locking ring thus being relieved of said pressure and of excessive frictional resistance in the thread, is then turnable easily when assembling or disassembling the rotor bowl.

24 Claims, 11 Drawing Figures

CENTRIFUGE PRESSURE RELIEF DEVICE

This invention relates to centrifugal machines, and more in particular to the rotor of the so-called nozzle type centrifugal machines.

This invention is particularly concerned with a problem encountered in the process of assembling the rotor or rotor bowl of such a machine as may be required for inspection.

In such a rotor, a threaded locking ring secures the top cover section to the main body section of the rotor bowl against the internal pressure exerted by a stack of compressed separating discs. In order to insure their proper functioning these discs are confined under pressure between the top and bottom of the rotor bowl. These discs consisting of thin sheet metal are formed usually with radial narrow ribs or other projection, for providing a desired spacing between the discs. The stack of discs must therefore be compressed sufficiently in order to insure that spacing.

The stack of trunco-conically shaped discs concentrically surrounds the rotor shaft which extends rigidly from the bottom of said main body section through the open top end of said cover section.

The size of the machine and the diameter of the rotor bowl, determine the size of the discs and the number of discs contained in a stack. These factors in turn determine the amount of force needed to compress the stack so that it will assume the aforementioned tightly packed condition.

For example, a rotor may have a diameter at the outer periphery of from about 18 inches to about 42 inches, each rotor containing a suitable number of discs depending upon the required spacing thereof. In view of such variables as size and spacing, a rotor as a rough example may contain a stack of from about 80 to about 160 discs.

The stack compression force to be compensated for by the relief device, may run into the thousands of pounds. It is at least that compression force that must be absorbed in the threads of the said locking ring.

Therefore, the aforementioned problem encountered when assembling or disassembling the rotor bowl is due to the great frictional resistance developing in the thread when attempting to turn the locking ring. Excessive effort and great force, has had to be applied in the past for turning the locking against such resistance, until at last it was either freed and detached in disassembly, or else seated in the assembly operation which may involve the hazard of damage to the locking ring and of galling of the thread.

It is therefore one object of this invention to greatly ease and facilitate the turning of the locking ring in the thread so that only a minimum turning force or torque effort need be applied.

The invention is based upon the concept whereby the internal pressure thus exerted by the stack of discs, can be absorbed and held by means separate from the locking ring, so that the ring be thus be relieved of that pressure during the assembly and disassembly operation.

In view of that objective, the invention provides a method and means for separately applying interbalanced forces to the respective sections of the rotor bowl, sufficiently great to absorb the pressure from the stack of separating discs, instead of allowing that pressure to act upon the locking ring itself. When thus relieved of the aforementioned frictional resistance in the threads, the locking ring can then be turned with ease, that is without necessitating the aforementioned excessive and potentially damaging torque application during the assembly or disassembly operation.

The foregoing underlying principle, as an example may be embodied in a pressure relief device for the locking ring, which when installed comprises a detachable abutment member secured upon the free end portion of the rotor shaft, and jack devices or means in the nature of hydraulic rams, expandable between said abutment member and the top cover section of the rotor bowl. Expanding these jack devices will set up a pair of internally interbalanced forces, namely a tension force acting upon the rotor shaft and a corresponding reaction compression force acting upon the top cover section of the rotor bowl. These forces will tend to hold the two sections of the rotor bowl compressed towards each other sufficiently to provide the aforementioned pressure relief for the locking ring.

Preferably, automatic safety means are provided to function in cooperative relationship with the pressure relief device, to prevent the pressure relief forces exerted by the jack devices, from exceeding a predetermined limitation or excessive tension imposed upon the rotor shaft. Such safety means may be in the nature of compression spring devices directly associated with or under the influence of the jack devices or hydraulic ram.

Specific features are found in the construction and arrangement of a hydraulic ram, and of the force limiting devices.

Other features and advantages will hereinafter appear.

FIG. 1 is a vertical sectional view of an example of the rotor of a nozzle type centrifugal machine, illustrating the force normally acting upon the locking ring due to compression of the stack of separating discs.

FIG. 1*a* is a detail view of a coupling member or hanger engaging the threaded top end portion of the rotor shaft.

Figure 4A:
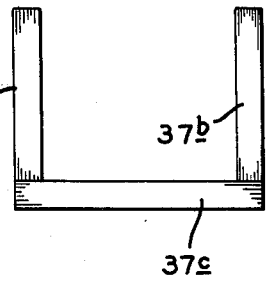
FIG. 4 is an enlarged vertical sectional view of the pressure relief device appearing in FIG. 3, with operating parts thereof in neutral position prior to hydraulic actuating pressure being applied.
Figure 4:
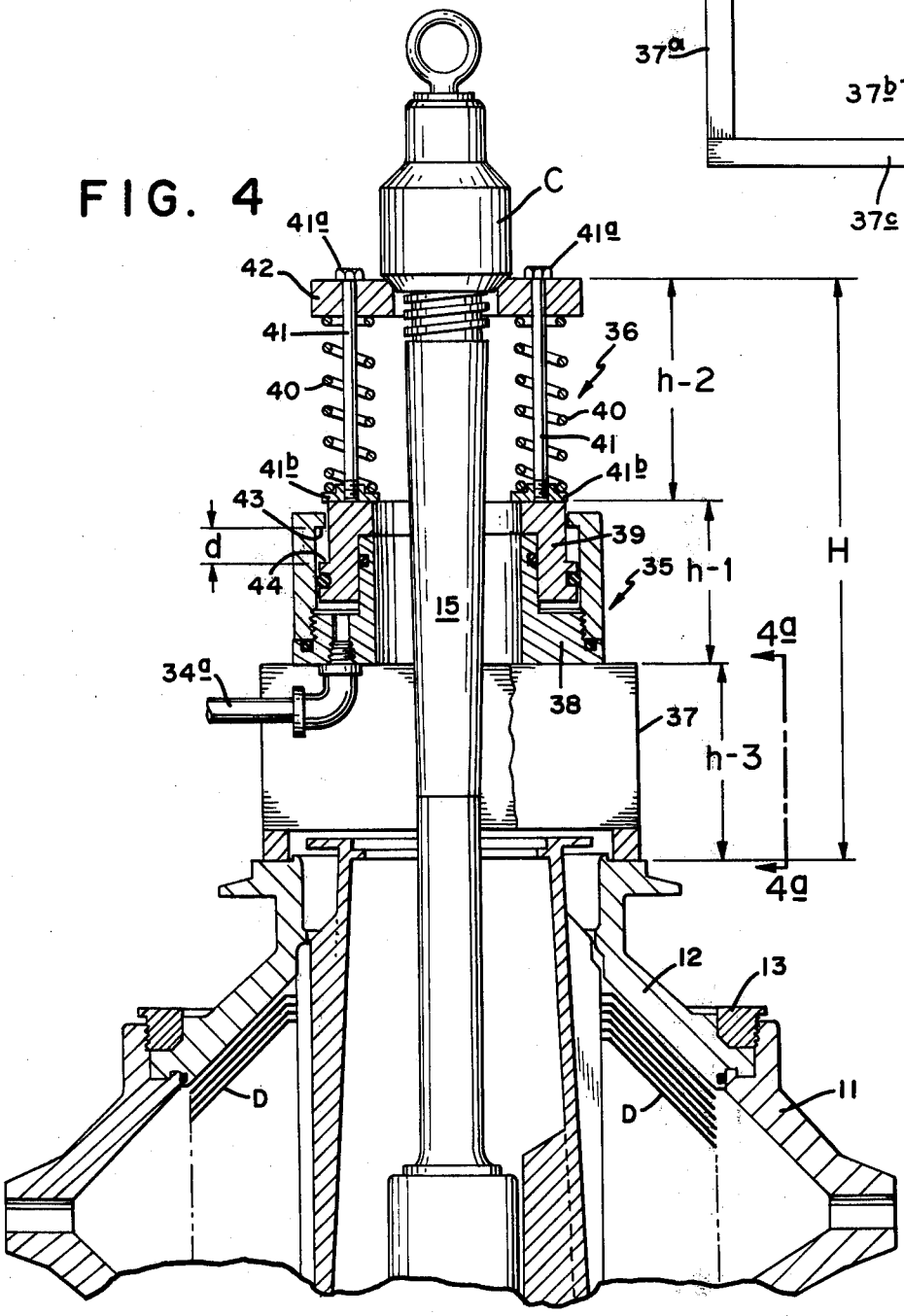

FIG. 4*a* is a detail end view taken on line 4*a* — 4*a* in FIG. 4 of the adaptor structure that supports the pressure relief device.

Figure 5:
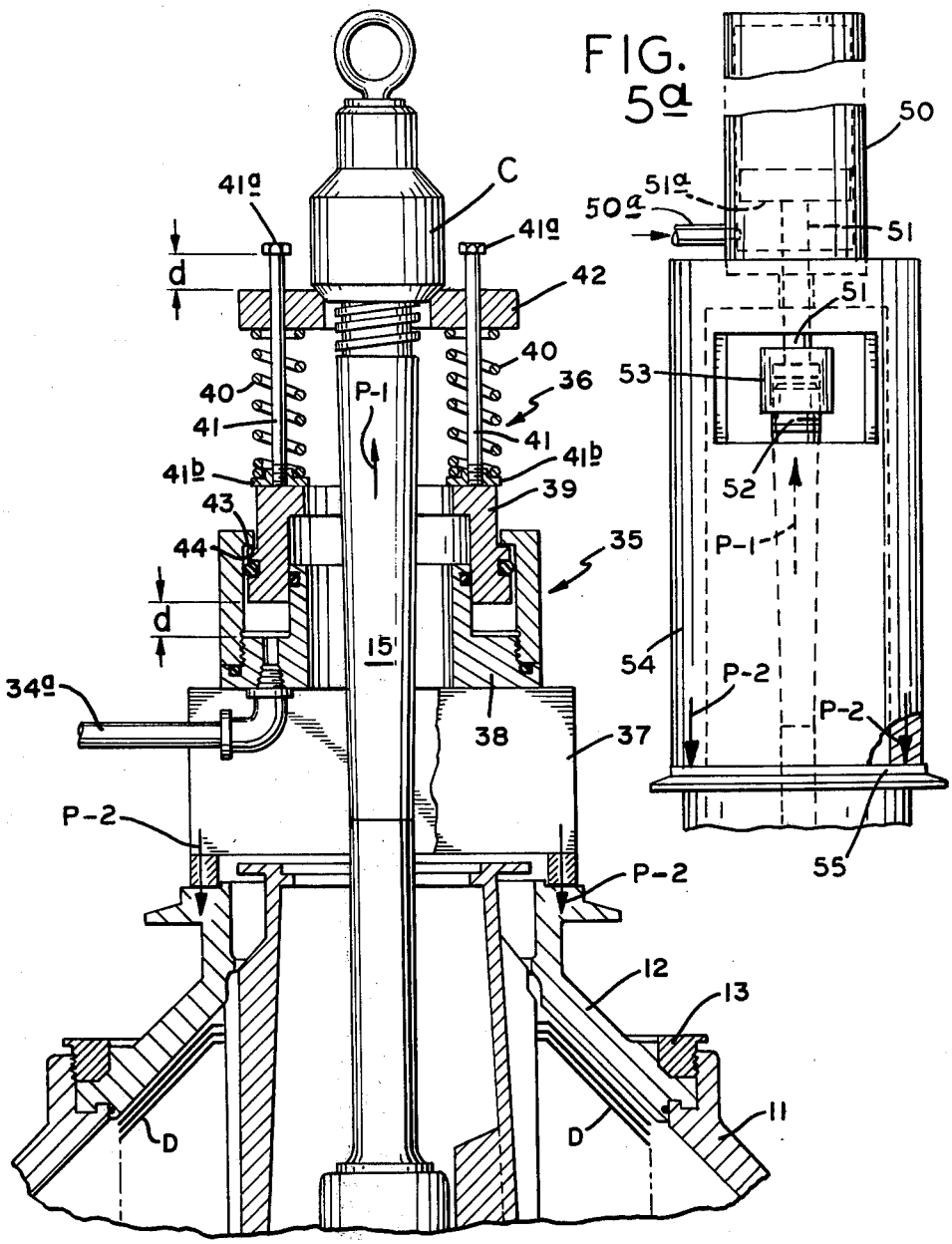

FIG. 5 is a vertical sectional view of the pressure relief device, similar to FIG. 4, with the parts held by the hydraulic actuating pressure in pressure relieving position.

FIG. 5*a* shows another embodiment of the pressure relief device.

Figure 6:
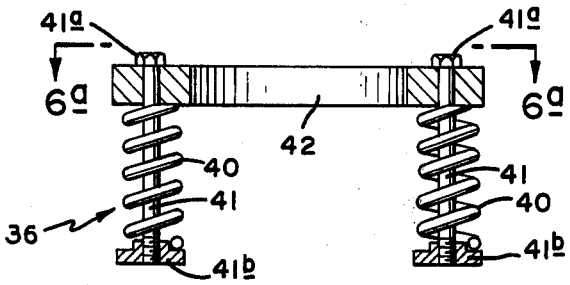

FIG. 6 is a detail view of a spring assembly unit taken from FIG. 4, as part of the pressure relief device.

Figure 6A:
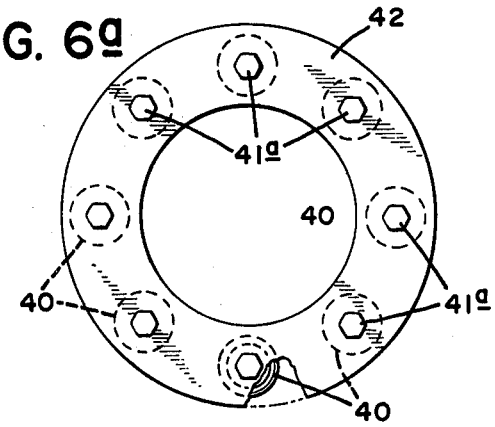

FIG. 6*a* is a top view taken on line 6*a* — 6*a* of FIG. 6.

Figure 7:
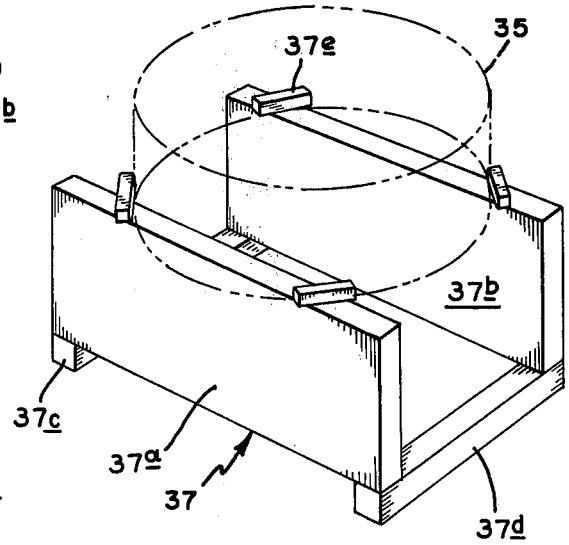
Figure 3:
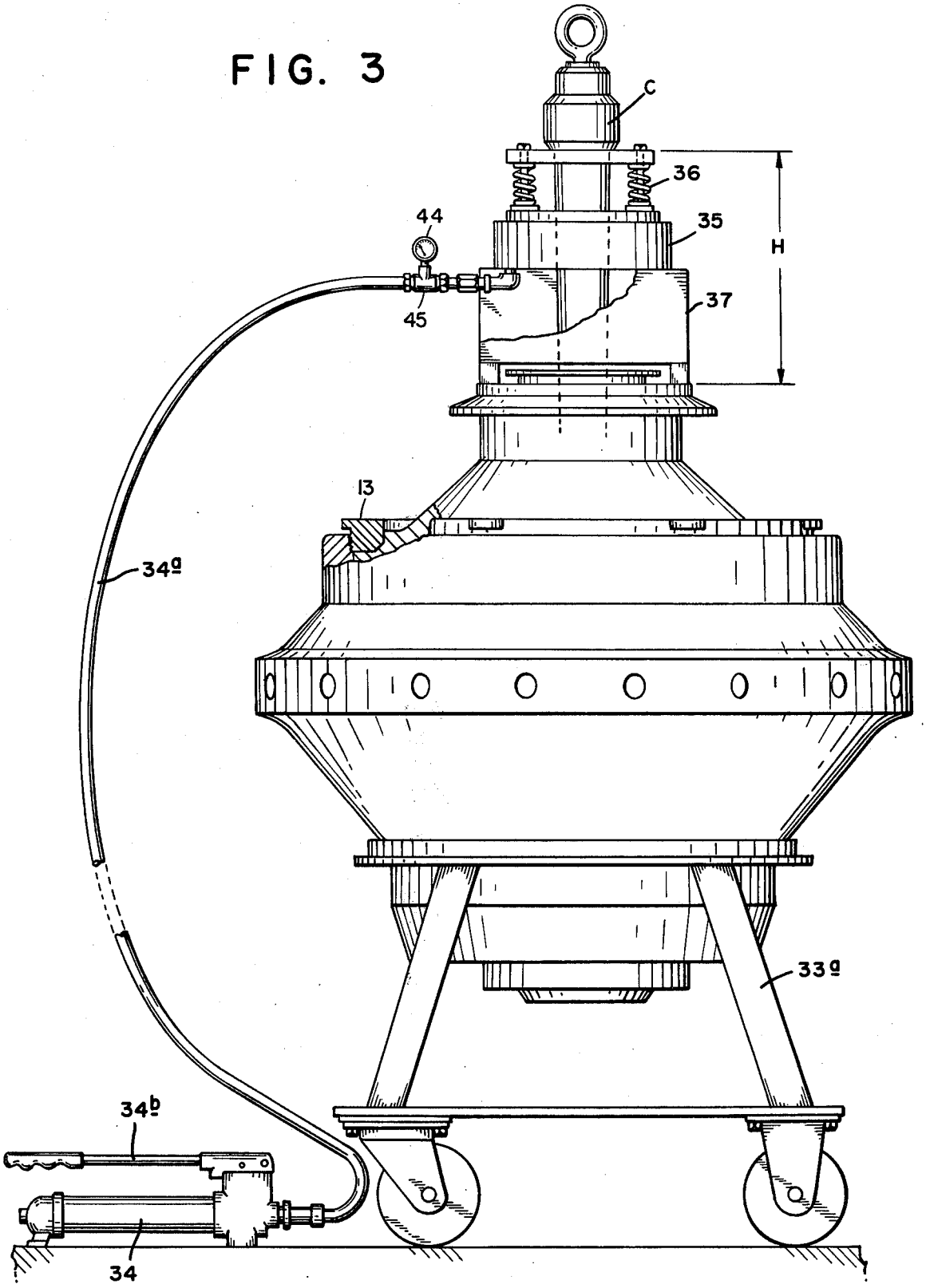
FIG. 3 is an external elevational view of the rotor supported on a stand, and showing one embodiment of the pressure relief device in place, and operable by actuating an hydraulic pump.

FIG. 7 is a perspective detail view of an adaptor spacer structure for the pressure relief device of FIGS. 3, 4, and 5.

Figures 1, 1A:
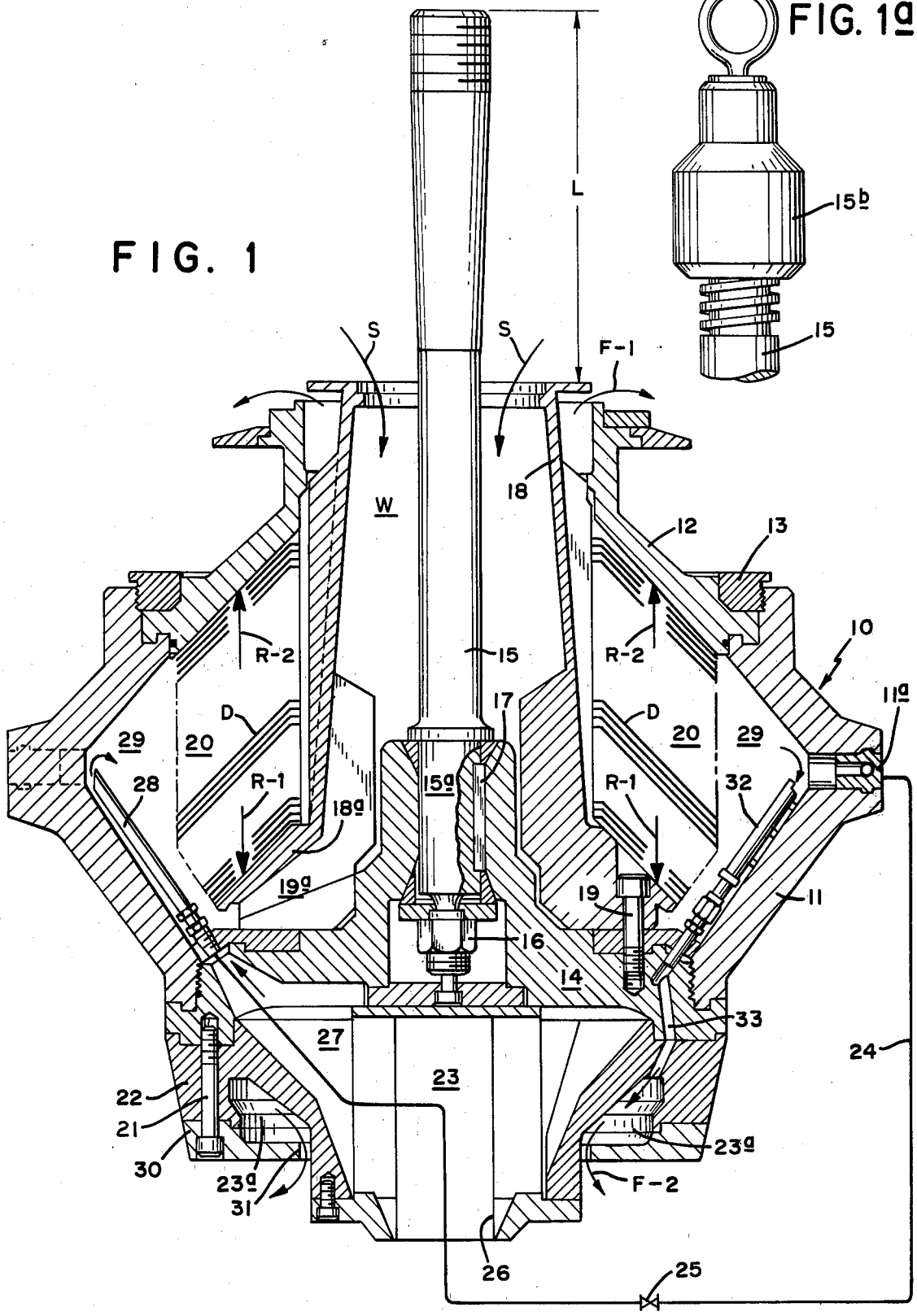
Figure 2:
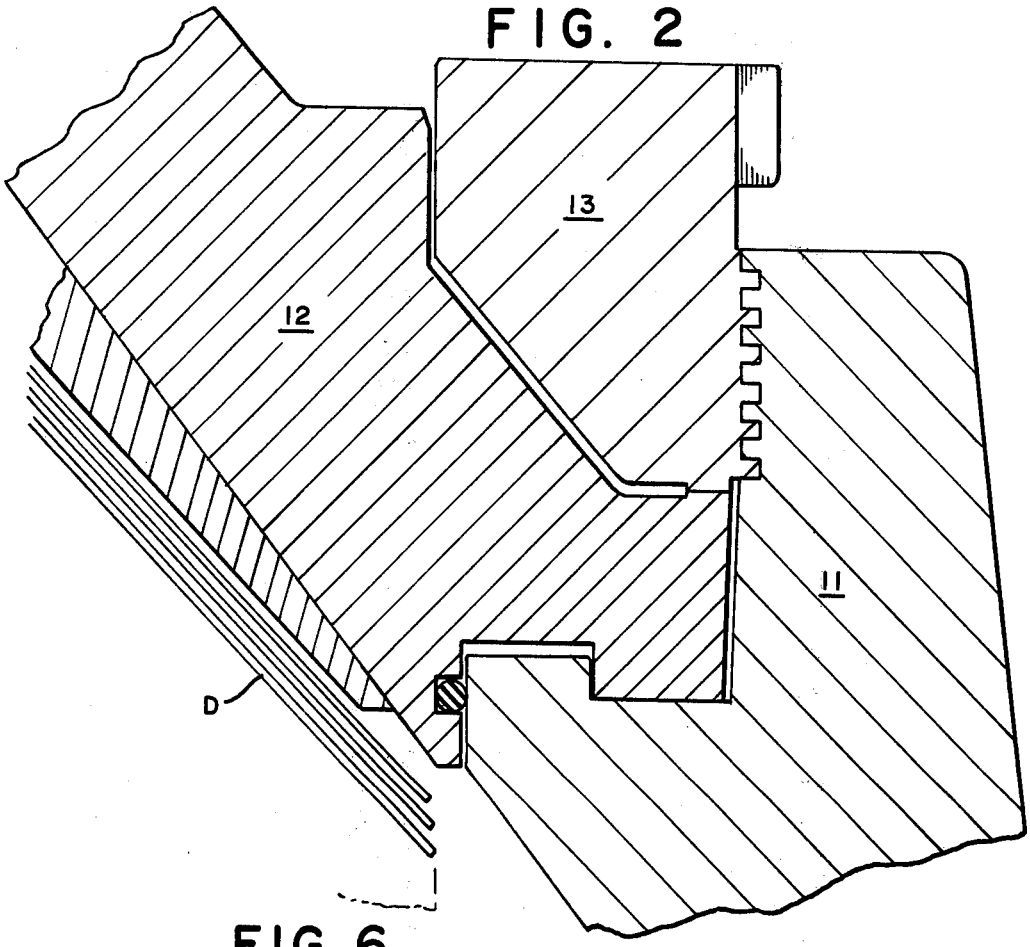
FIG. 2 is a greatly enlarged partial detail view in vertical section of the locking ring in place, taken from the showing thereof in FIG. 1.

The pressure relief device of this invention is applicable to a centrifuge rotor of the nozzle type as exemplified in FIG. 1, which comprises a rotor bowl 10 of generally double conical configuration. The rotor bowl is composed of a main body section 11 provided with discharge nozzles 11*a*, and a top cover section 12 secured to the main body section by means of a customary threaded locking ring 13.

When this rotor operates within the customary housing (not shown), the nozzles discharge a heavy or so-called underflow fraction as a result of centrifugal separation of a feed suspension as indicated by arrows "S" pointing into the feed well "W" of the rotor. A light fraction (see arrow F-1) overflows from the top end of the rotor bowl, while an intermediate fraction (See arrow F-2) overflows from the bottom end of the rotor structure.

The bottom of the main body section is formed by a hub portion 14. A rotor shaft 15 has a footend portion 15*a* rigidly connected to the hub portion by means of a locking nut 16 engaging the threaded lower end portion of the shaft. A key connection 17 provides rigid torque transmitting relationship between the hub portion and the shaft. This shaft extends upwardly through the open end portion of the rotor bowl, thus having an upper exposed end portion indicated by length "L" and provided with a customary external thread at the top for connection with a drive mechanism. An internally threaded coupling member 15*b* fitting the external thread on the shaft is usually supplied for engagement by a hoist.

The rotor shaft 15 is surrounded by a feed well member 18 for the feed suspension (see arrows S), which feed well member has a flared substantially frusto conical footend portion 18*a* bolted at 19 to the hub or bottom portion 14 of the rotor bowl. This footend portion of the feedwell member has radially outwardly, directed flow passages 19*a* delivering the feed suspension from feedwell 18 to the centrifugal separating chamber 20 formed by the two sections of the rotor bowl, and containing a stack of separating discs.

Fitted over the feed well member 18 is the customary stack of separating discs "D" held compressed between the two sections of the rotor bowl, as indicated by the opposedly directed reaction force arrows R-1 and R-2.

Bolted at 21 to the bottom of the rotor bowl is a generally frusto conical inverted extension member 22 providing a receiving chamber 23 for recirculation at a controllable rate of underflow material from the discharge nozzles 11*a* into the centrifugal separating chamber 20, this for the known purpose of controlling the underflow solids concentration of the heavy fraction delivered by the nozzles. Such underflow recirculation is indicated by a return pipe line 24 provided with a control valve 25.

The underflow return material is injected into the receiving chamber 23 through bottom opening 26, where it is subjected to the centrifugal effect of accelerator blades 27. Thus, the material is forced upwardly through an array of outwardly diverging underflow return tubes 28 terminating in the peripheral portion 29 of the centrifugal separating chamber 20, which portion 29 surrounds the stack of separating discs.

The bottom extension member 22 or receiving underflow chamber 23 is surrounded by an annular effluent chamber 23*a* formed by an annular member 30 connected to the member 22 by the bolts 21, and presenting an overflow weir 31 for discharging the aforementioned intermediate fraction F-2.

Accordingly, this latter fraction derived from an intermediate annular separating zone in separating chamber 20, enters a set of downwardly converging discharge tubes 32 alternating with the aforementioned divergent underflow return tubes 28. Centrifugal pressure causes the intermediate fraction to pass from said intermediate separating zone inwardly through the converging tubes 32, and then through passages 33 to the annular effluent chamber 23*a*, and thus for delivery past the overflow weir 31.

The foregoing outline of the rotor shown here as an example providing the background for this invention, has been derived from the identical showing thereof in U.S. patent to Honeychurch U.S. Pat. No. 3,279,689.

DESCRIPTION OF THE PRESSURE RELIEF DEVICE

In prior practice great and excessive effort was required for turning the locking ring 13 in the thread against high frictional resistance resulting from the compression force reaction exerted by the stack of separating discs "D" confined between the two sections of the rotor bowl.

This undesirable condition will best be understood from the fact that in the past excessive effort and violent force, ans with the use of sledge hammers wielded by two men against the lugs provided on the locking ring, has had to be applied in order to effect "unfreezing" or loosening as well as turning of the locking ring against such resistance in the thread. This effort had to be sustained until the locking ring was either freed and finally detached in disassembly, or else until properly tightened and seated in the assembly operation. That practice therefore involved the hazard of damage to the locking ring and/or to associated parts as well as possible galling of the threads.

This undesirable condition, however, is remediable by the pressure relief devices provided by this invention, and presently to be described.

If a centrifuge rotor of the class described above is due for inspection or overhaul, the rotor shaft is disconnected from its overhead drive mechanism which latter is then swung out of the way, so that thereupon the top cover portion of the housing structure can be disconnected and removed. The rotor may then be hoisted out of the body of the housing after the aforementioned coupling member "C" or hanger has been secured to the now free threaded upper end portion of the rotor shaft. With the aid of this coupling member, the rotor is then lifted and deposited upon the movable carrier or cart construction 33*a* shown in FIG. 3.

The coupling member "C" may then be removed so as to allow the generally annular pressure relief device or assembly here designated by its height "H," to be placed over the exposed upper end portion of the rotor shaft, and seated upon the top cover section of the rotor bowl. The coupling member "C" is then re-applied to the shaft, to act as an abutment member confining the pressure relief device from the top.

Of course it is also possible to complete the mounting and seating of the pressure relief device upon the rotor structure before lifting the same onto the carrier 33*a*.

But once this is done, an hydraulic hand pump (see FIG. 3) may be operated to supply hydraulic actuating pressure to the pressure relief device by way of a flexible tube connection 34*a*.

The construction and function proper of one embodiment of the pressure relief device, is now described as follows by reference to FIGS. 4 and 5.

The pressure relief device when in place, exemplified in the embodiment of FIGS. 4 and 5, comprises an annular hydraulic jack or ram 35 also designated by its height *h*-1, a spring assembly unit 36 also designated by its height *h*-2, and an adaptor member or support structure 37 also designated by its height *h*-3. Resting atop the top cover section 12, see FIG. 4, the pressure relief device is shown in neutral or inactive or non-pressurized condition, occupying the height "H" between the coupling member "C" and the top cover section 12 of the rotor bowl. The hydraulic pressure supply tube or hose 34*a* leads to the bottom of the hydraulic ram.

The support structure also termed adaptor structure 37 (see also detail FIG. 7) may comprise a pair of horizontally spaced parallel upright wall members 37*a* and 37*b* rigidly interconnected at the bottom of a pair of horizontal transverse members 37*c* and 37*d*. Fixed to the top of the upstanding wall members are four locating lugs 37*e* arranged for positioning the hydraulic ram 35. The hydraulic pressure tube connection 34*a* leading to the bottom of the hydraulic ram is accommodated in the space between the two upright wall members 37*a* and 37*b*.

One preferred form of the hydraulic ram supported on the adaptor structure 37, is shown to be of generally annular construction concentrically surrounding the rotor shaft. Accordingly, this ram comprises what is herein termed an annular hydraulic cylinder 38 and a correspondingly shaped annular piston 39, with sealing rings shown to be effective between the two.

The piston cooperates directly with the spring assembly unit 36, also disposed around the rotor shaft and shown in untensioned condition due to the retracted position of the piston 39 in FIG. 4.

The spring assembly unit 36 confined between the piston 39 and the coupling or abutment member "C," may be of any suitable arrangement and construction, but in the present embodiment comprises a set of vertical compression coil springs 40 evenly spaced around the rotor shaft. Each said coil spring has a central retaining rod 41 slidable in an annular support member 42 surrounding the rotor shaft adjacent to the coupling member "C." Each said retaining rod may be in the form of a bolt 41 having a head or stop member 41*a* at the upper end, and a threaded lower end engaged by a retaining nut 41*b*. Each said coil spring is thus held confined although substantially untensioned between a respective retaining nut at the bottom, and the annular support member 42 at the top, as is well illustrated in the detail FIGS. 6 and 6*a* of such a self contained spring assembly unit.

Referring to FIG. 4 and FIG. 5, the operation of this pressure relief device of the invention is described as follows: In order to relieve the load imposed upon the locking ring 13, prior to its removal to allow for disassembly of the rotor bowl, hydraulic pressure may be supplied to the annular hydraulic ram from any suitable source, but conveniently by means of the hydraulic hand pump 34 the handle 34*b* of which is repeatedly moved up and down to operate the pump. The hydraulic fluid thus being pumped will cause expansion of the hydraulic jack against pressure of the associated spring assembly 36 until a predetermined extent or distance of compression of the spring assembly will have been reached.

The distance or extent of compression of the spring assembly by the piston 39 is predetermined by an internal annular shoulder 43 formed within the annular hydraulic cylinder. This shoulder constitutes a stop when engaged by a corresponding external annular shoulder 44 formed on annular piston 39. The thus predetermined travel distance "*d*" of the piston (see FIG. 5), is equivalent to the amount of compression of the spring assembly as a whole, and is equally represented by the exposed top end portions of the aforementioned spring retainer rods or bolts 41, projecting the distance "*d*" from the top face of the associated annular support member 42.

Once this compression stop limit will have been reached, there will have been established in the rotor structure or rotor bowl a pair of interbalanced substitute forces of predetermined magnitude, providing relief of the locking ring from the internal pressure exerted by the compressed stack of separating discs.

In other words, these substitute forces are braced against each other, imposing a tension force P-1 on the rotor shaft, interbalanced with an equal compression reaction force P-2 acting upon the top cover section of the rotor bowl. The net result is that the two sections of the rotor bowl are thus held pressed against each other, thereby relieving the locking ring 13 of frictional resistance, so that only minor effort is required for turning it in the thread for the purpose of disassembly or assembly of the rotor bowl.

It will thus be seen that the substitute forces P-1 and P-2 imposed by the pressure relief device are limited to a predetermined magnitude as determined by the limit of compression and by the characteristics of the springs. Therefore, continued operation of the hydraulic pump will simply allow the pressure fluid under excess pressure to recirculate harmlessly within the pump through a safety relief valve built into the pump, while maintaining said limited compression of the springs.

Yet, by suitable selection of the characteristics of the springs, the spring assembly will present a safe guard against imposing excessive tension stress upon the rotor shaft, even while providing the aforementioned relief for the locking ring. That is to say, the tension stress upon the shaft cannot exceed the predetermined force required for the limited maximum extent of spring compression.

It will therefore also be understood that spring assembly units of different spring characteristics may be selected depending upon the size and number of the separating discs, and hence upon the substitute compression force requirements of respective different machines.

It will also be understood that the invention is not limited to the structural details shown in this embodiment. For example, a plurality of individual but hydraulically intercommunicating identical hydraulic jack cylinders may be substituted, located around the rotor shaft evenly spaced from one another. Other forms of spring arrangements may be substituted, for example a coil spring of larger diameter concentrically surrounding the rotor shaft, or a combination of such springs concentric with one another or nested within one another. Clearly also, the adaptor support structure 37 for the relief device may assume different kinds of structural arrangement and configuration.

In FIG. 3, a pressure gauge 44 is shown connected to the fitting 45 that connects the pressure line 34*a* to the hydraulic jack 35. The pressure indications will provide a measure of the pressure relief force exerted by the hydraulic jack, irrespective of the presence or absence of the springs.

FIG. 5*a* shows another embodiment of the pressure relief device of FIG. 5. In a simplified form, and omitting the spring arrangement, this embodiment comprises an inverted hydraulic power cylinder 50 with a downwardly extending piston rod 51 detachably connected to the upper externally threaded end of rotor shaft 52, by means of an internally threaded coupling member 53 rotatably connected to the piston rod. A tubular spacer member 54 concentric with rotor shaft, supports the power cylinder or inverted hydraulic jack upon the top cover section 55 of the rotor bowl.

Accordingly, if hydraulic pressure fluid is supplied at 50*a* to the underside of piston 51*a* of the power cylinder, a pair of interbalanced forces P-1 and P-2 will be imposed upon the rotor shaft and upon the top cover section of the rotor bowl respectively, applied to the extent of relieving the locking ring in the manner and for the purpose previously set forth. A spring assembly may be included to function in the manner and for the purpose previously described, but has not been shown. For example, the spring assembly may be interposed between the hydraulic jack 50 and the spacer member 54, or between the spacer member 54 and the top cover member 55 of the rotor bowl.

I claim:

1. A pressure relief device for use in combination with the rotor of a nozzle type centrifugal machine having a threaded locking ring securing the cover section to the main body section of the rotor bowl against internal compression pressure exerted by a stack of separating discs confined between the top and bottom of the rotor bowl, and concentrically surrounding the rotor shaft, said shaft extending from said main body section through the open end of said cover section, said pressure relief device being located within the area surrounded by said locking ring, comprising force imparting means cooperatively associated with the upwardly exposed end portion of said shaft and with said cover section, said force imparting means being constructed and arranged to be operable so that said force imparting means impose a tension force upon said shaft and a corresponding reaction pressure force upon said cover section, said interacting forces forcing said sections towards each other and against the internal pressure of said separating discs, thereby relieving said locking ring from said internal pressure during assembly or disassembly of the rotor bowl.

2. The combination according to claim 1, wherein said force imparting means comprise an annular hydraulic ram concentrically surrounding said shaft.

3. A pressure relief device for use in combination with the rotor of a nozzle type centrifugal machine having a threaded locking ring securing the cover section to the main body section of the rotor bowl against internal compression pressure exerted by a stack of separating discs confined between the top and bottom of the rotor bowl, and concentrically surrounding the rotor shaft, said shaft extending from said body section through the open end of said cover section, said pressure relief device comprising hydraulic jack devices constructed and arranged so as to be operable to impose a tension force on said rotor shaft, and a reaction compression force on said cover section of the rotor bowl, whereby said cover section and said main body section of the rotor bowl are pressed against each other, stop means defining a predetermined limit of expansion of the jack devices by pressure fluid, and compression spring means constructed and arranged so as to oppose expansion of the jack devices to said limit of expansion.

4. The combination according to claim 3, wherein said hydraulic jack devices are in the form of an annular hydraulic ram concentrically surrounding said rotor shaft.

5. The combination according to claim 3, wherein said hydraulic jack devices comprise an inverted hydraulic power cylinder having a piston and a piston rod concentric with the rotor shaft, and extending sealingly through the bottom of said power cylinder, and having pressure fluid connection to the underside of said piston, a spacer member providing support for said power cylinder in said cover section of the rotor bowl, and coupling means for connecting the piston rod with the rotor shaft.

6. A pressure relief device for use in combination with the rotor of a nozzle type centrifugal machine having a threaded locking ring securing the cover section to the main body section of the rotor bowl against internal compression pressure exerted by a stack of separating discs confined between the top and bottom of the rotor bowl, and concentrically surrounding the rotor shaft, said shaft extending from said main body section through the open end of said cover section, said pressure relief device being located within the area surrounded by said locking ring, comprising abutment means secured upon the upper end portion of said rotor shaft, and hydraulic jack devices associated with the exposed upper end portion of said rotor shaft between said abutment means and said cover section, said jack devices being constructed and arranged to be operable so that expansion thereof by pressure fluid will impose a tension force upon said shaft and a corresponding compression force upon said cover section, said interacting forces forcing said sections towards each other and against the internal pressure of said separating discs, thereby relieving said locking ring from said internal pressure during assembly or disassembly of the rotor bowl.

7. The combination according to claim 6, wherein said hydraulic jack devices are in the form of an annular hydraulic ram concentrically surrounding said rotor shaft.

8. A pressure relief device for use in combination with the rotor of a nozzle type centrifugal machine having a threaded locking ring securing the cover section to the main body section of the rotor bowl against internal compression pressure exerted by a stack of separating discs confined between the top and bottom of the rotor bowl, and concentrically surrounding the rotor shaft, said shaft extending from said main body section through the open end of said cover section, said pressure relief device comprising abutment means secured upon the outer end portion of said rotor shaft, and hydraulic jack means disposed so as to be effective between said abutment member and said cover section, said jack means being constructed and arranged so as to be operable to impose a tension force upon said shaft and a corresponding reaction pressure force upon said cover section, said interacting forces relieving said locking ring from pressure of said stack of separating discs, during assembly or disassembly of the rotor bowl, said jack means having a predetermined limit of expansion, with the addition of resiliently compressible means subject to the expansion of said jack means, and thus adapted to be compressed of said limit of expansion, the amount of said compression at said limit of expansion representing the amount of tension thus allowed to act upon the shaft, during assembly or disassembly of the rotor bowl.

9. The combination according to claim 8, wherein said hydraulic jack means comprise an annular hydraulic ram concentrically surrounding said shaft.

10. A pressure relief device for use in combination with the rotor of a nozzle type centrifugal machine having a threaded locking ring securing the cover section to the main body section of the rotor bowl against compression pressure exerted by a stack of separating discs surrounding the rotor shaft, and confined between the top and bottom of the rotor bowl, said shaft extending from said main body section through the open end of said cover section, said pressure relief device comprising hydraulic jack devices constructed and arranged so as to be operable to impose a tension force on said rotor shaft, interacting with a reaction compression force on said cover section of the rotor bowl, whereby said cover section and said main body section of the rotor bowl are pressed against each other, and means for automatically limiting said compression force and thus the tension stress upon said shaft.

11. A pressure relief device for use in combination with the rotor of a nozzle type centrifugal machine having a threaded locking ring securing the cover section to the main body section of the rotor bowl against compression pressure exerted by a stack of separating discs surrounding the rotor shaft, and confined between the top and bottom of the rotor bowl, said shaft extending from said main body section through the open end of said cover section, said pressure relief device comprising an abutment member secured to the outer end portion of the rotor shaft, hydraulic jack devices disposed between said abutment member and said cover section, operable to impose a tension force on said rotor shaft, and a reaction compression force on said cover section of the rotor bowl, whereby said cover section and said main body section of the rotor bowl are pressed against each other, stop means defining a predetermined limit of expansion of the jack devices by pressure fluid, and compression spring means constructed and arranged to oppose expansion of the jack devices to said limit of expansion.

12. The pressure relief device according to claim 11, wherein said jack devices comprise an hydraulic ram of annular construction surrounding said rotor shaft in substantially concentric relationship therewith.

13. The pressure relief device according to claim 11, wherein said spring means comprise a plurality of compression coil springs spaced around the rotor shaft.

14. The pressure relief device according to claim 11, wherein said spring means comprise a plurality of compression coil springs spaced around the rotor shaft, said spring means being interposed between said jack devices and said abutment member.

15. The pressure relief device according to claim 11, wherein said spring means comprise a self-contained assembly of a plurality of compression coil springs spaced around the rotor shaft, said assembly being interposed between said jack devices and said abutment member, said spring assembly in turn comprising an annular support member adjoining said abutment member coaxial therewith, and a set of said compression coil springs extending from said annular support member to said jack devices, and retaining means for holding said coil springs attached to said annular support member, thus constituting said self-contained assembly. pg,31

16. The pressure relief device according to claim 11 wherein said spring means comprise a self-contained assembly of a plurality of compression coil springs spaced around the rotor shaft, said assembly being interposed between said jack devices and said abutment member, said spring assembly in turn comprising an annular support member adjoining the underside of said abutment member coaxial therewith, and a set of said compression coil springs extending from said annular support member to said jack devices, and retaining means for holding said coil springs attached to said annular support member, said retaining means in turn comprising a rod extending axially in each said spring, and also through said annular support member in sliding relationship therewith, said rod having stop means at each end, effective to keep said coil springs attached to said annular member, so that said annular member, said coil springs, and said retaining means constitute said self-contained assembly unit.

17. The pressure relief device according to claim 11, wherein said jack devices comprise an hydraulic ram of annular construction surrounding said rotor shaft in substantially concentric relationship therewith, and having an annular piston movable relative to the rotor shaft, in an annular cylinder stationary relative to the shaft, and wherein said spring means are interposed between said annular piston and said abutment member.

18. The pressure relief device according to claim 11, wherein said jack devices comprise an hydraulic ram of annular construction surrounding said rotor shaft in substantially concentric relationship therewith, and having an annular piston movable relative to the shaft, in an annular cylinder stationary relative to the shaft, wherein said spring means are interposed between said annular piston and said abutment member, wherein spacer means are interposed between said annular cylinder and top cover section, and wherein an hydraulic pressure fluid supply pipe is connected to the bottom of said annular cylinder.

19. The pressure relief device according to claim 11, wherein said jack devices comprise an hydraulic ram of annular construction freely surrounding said rotor shaft in concentric relationship therewith, and wherein said spring means are interposed between said annular ram and said abutment member.

20. A pressure relief device for use in combination with the rotor of a nozzle type centrifugal machine having a threaded locking ring securing the cover section to the main body section of the rotor bowl against the internal compression pressures exerted by a stack of separating discs confined between the top and bottom of the rotor bowl, and concentrically surrounding the rotor shaft, said shaft extending from said main body section through the open end of said cover section, said pressure relief device for said locking ring comprising an inverted hydraulic power cylinder having a piston and a piston rod concentric with the rotor shaft, said piston rod extending sealingly through the bottom of said cylinder, said cylinder having a pressure fluid connection to the underside of said piston, a spacer member providing support for said power cylinder relative to said cover section of the rotor bowl, and coupling means for connecting the piston rod with the rotor shaft.

21. The method of assembling or disassembling the rotor of a nozzle type centrifugal machine wherein a threaded locking ring secures the cover section to the main body section of the rotor bowl against the internal compression pressure exerted by a stack of separating discs confined between the top and bottom of the rotor bowl, and concentrically surrounding the rotor shaft, said shaft extending from said main body section through the open top end of said cover section, which method comprises applying to said main body section an axially inwardly directed force by exerting a tension force upon the shaft interbalanced within said rotor with a corresponding reaction compression force acting on said cover section, and holding said main body section and said cover section thus forced towards each other against said internal pressure from the separating discs, during assembly or disassembly of said locking ring.

22. The method according to claim 21, wherein said interbalanced pressures are applied and maintained hydraulically.

23. The method of assembling or disassembly the rotor of a nozzle type centrifugal machine wherein a threaded locking ring secures the cover section to the main body section of the rotor bowl against the internal compression pressure exerted by a stack of separating discs confined between the top and bottom of the rotor bowl, and concentrically surrounding the rotor shaft, said shaft extending from said main body section through the open top end of said cover section, which method comprises applying to said main body section an axially inwardly directed force by exerting a tension force on the shaft, interbalanced within said rotor with a corresponding reaction compression force acting on said cover section, holding said main body section and said cover section thus forced towards each other against said internal pressure from the separating discs, during assembly or disassembly of said locking ring, and automatically limiting the tension force imposed upon said shaft.

24. The method of assembling or disassembling the rotor of a nozzle type centrifugal machine wherein a threaded locking ring secures the top cover section to the main section of the rotor bowl against the internal compression pressure exerted by a stack of separating discs confined between the top and bottom of the rotor bowl, and concentrically surrounding the rotor shaft, said shaft extending from the bottom of said main section through the open top end of said cover section, which method comprises hydraulically applying to said rotor shaft a tension force interbalanced with a compression force acting on said cover section of the rotor bowl, whereby the main section of the rotor bowl and said cover section are forced against each other and against said internal pressure from the separating discs, applying compression spring means in a manner to oppose the tension force imposed upon the rotor shaft, limiting the effect of said tension force upon said spring means, when a predetermined degree of spring compression is attained, and maintaining said degree of spring compression by said tension force during assembly or disassembly of said locking ring.

* * * * *